US009498947B2

(12) United States Patent
Jordan

(10) Patent No.: US 9,498,947 B2
(45) Date of Patent: Nov. 22, 2016

(54) METHOD FOR CREATING TAMPER-EVIDENT LABELS

(71) Applicant: Robert C. Jordan, St. Paul, MN (US)

(72) Inventor: Robert C. Jordan, St. Paul, MN (US)

( * ) Notice: Subject to any disclaimer, the term of this patent is extended or adjusted under 35 U.S.C. 154(b) by 0 days.

(21) Appl. No.: 14/828,087

(22) Filed: Aug. 17, 2015

(65) Prior Publication Data

US 2016/0046136 A1 Feb. 18, 2016

Related U.S. Application Data

(60) Provisional application No. 62/038,585, filed on Aug. 18, 2014.

(51) Int. Cl.

| | |
|---|---|
| ***B41M 3/14*** | (2006.01) |
| ***B41J 2/01*** | (2006.01) |
| ***B41M 3/00*** | (2006.01) |

(52) U.S. Cl.

CPC . *B41J 2/01* (2013.01); *B41M 3/00* (2013.01); *B41M 3/14* (2013.01)

(58) Field of Classification Search

CPC ..... B41J 2/01; B41M 3/00; B41M 3/14

See application file for complete search history.

(56) References Cited

U.S. PATENT DOCUMENTS

| | | | | |
|---|---|---|---|---|
| 4,371,196 | A * | 2/1983 | von Kempski | B41M 3/14 283/57 |
| 4,837,061 | A * | 6/1989 | Smits | B65D 55/026 283/108 |
| 5,200,438 | A * | 4/1993 | Fujii | C08G 18/672 522/96 |
| 7,383,999 | B2 * | 6/2008 | Bi | G06K 19/06046 235/380 |
| 2004/0247832 | A1 * | 12/2004 | Koops | G09F 3/0292 428/156 |
| 2010/0022078 | A1 * | 1/2010 | Rockenberger | C09D 5/24 438/585 |

* cited by examiner

*Primary Examiner* — Julian Huffman
*Assistant Examiner* — Michael Konczal
(74) *Attorney, Agent, or Firm* — Leyendecker and Lemire, LLC

(57) ABSTRACT

A method for creating a tamper-evident label is described. Embodiments of the method or process typically include four steps. In a first step, an ultraviolet cured ink mask can be printed onto a substrate by an inkjet printer. In a second step, once the printing is done and the mask has been formed, the substrate can be anodized in a weakened anodizing bath. In a third step, the ultraviolet cured ink can be removed from the substrate leaving a portion of the substrate unanodized. To remove the ultraviolet cured ink, the substrate can be heated to an elevated temperature and a cleaning solution and/or solvent can be applied to the ultraviolet cured ink mask. In a fourth step, the substrate can be anodized for a second time.

20 Claims, 9 Drawing Sheets
(7 of 9 Drawing Sheet(s) Filed in Color)

METHOD FOR CREATING TAMPER-EVIDENT LABELS

CROSS-REFERENCE TO RELATED APPLICATION

This application claims the benefit of U.S. Provisional Application No. 62/038,585, filed Aug. 18, 2014.

BACKGROUND

Most printing technologies available today have been developed for the purpose of placing an image on a substrate, such as paper and plastic films, having a reasonable degree of permanence. Some of the typical technologies, which are all highly developed, include lithography, gravure, offset, toner fusion, flexographic, and inkjet. Toner fusion and inkjet technologies permit real-time continuously variable imaging.

The foregoing printing technologies have generally not been developed for mask printing applications. Mask printing applications include printed images that are durable enough to withstand exposure to various solvents, washes, and manufacturing processes. Mask printing applications are designed to be removed readily when the printed mask is no longer required. Currently, mask printing applications are used when creating tamper-evident labels.

For mask printing on metallic substrates, which are later intended to be anodized, water-based flexographic inks have been used with good success. Water-based flexographic inks remain in place during anodization steps and can be easily removed later in a water bath. In contrast, water-based ink jet inks and print-delivery systems (ink-jet heads) print poorly on metallic substrates and do not have the right combination of adhesion and removability to work as a printed mask when anodization steps are used. Conversely, images printed with ultraviolet cured inkjet inks show very high image definition and quality, but are much more difficult to remove with most commonly used industrial processes. As such, under most circumstances, UV cured inkjet inks do not have the right combination of adhesion and removability to work as a printed mask when anodization is used.

Therefore, there is a need for a method of implementing UV cured inks that produces a proper combination of adhesion and removability during anodization steps of mask printing and tamper-evident label creation.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION

Figure 1:
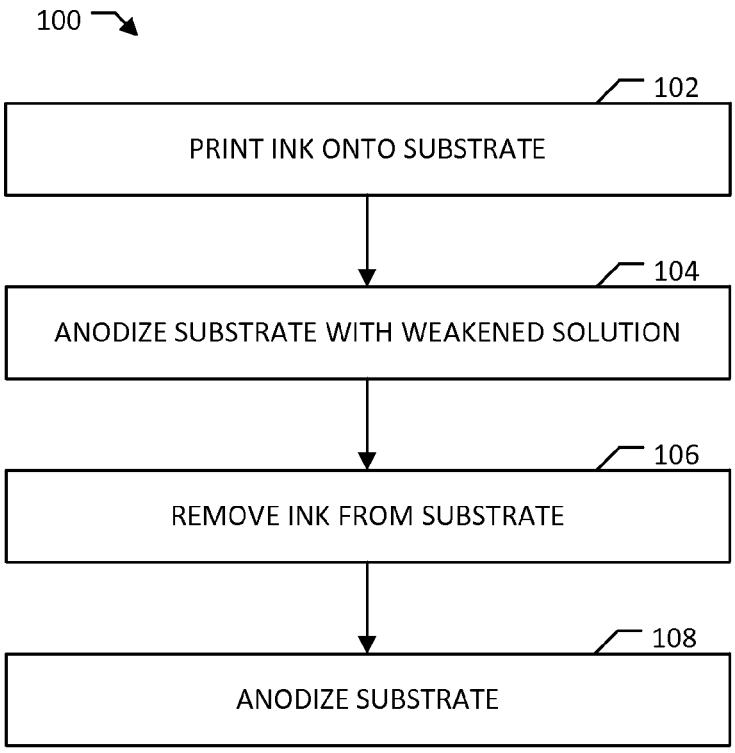
FIG. 1 is flow chart of a process for creating a tamper-evident label according to one embodiment of the present invention.

Embodiments of the present invention include a process or method for forming tamper-evident labels when implementing ultraviolet (UV) cured inks deposited by an inkjet printer. The process can include printing real-time continuously variable masks on metallic or metal oxide substrates. The process can further include one or more steps for removing inkjet printed UV cured inks as continuously variable masks. The inkjet printed UV cured ink masks can be durable enough to withstand various post printing processes including, but not limited to, anodizing without unacceptable degradation prior to removal of the UV cured ink mask.

In one embodiment, the process can be implemented using inkjet printed ultraviolet cured ink as a mask when creating a tamper-evident label. Typically, the process can be implemented when creating a metallic label that includes one or more anodizing steps. The process can include, but is not limited to, printing on a metallic substrate, anodizing the substrate, removing the printed ink from the substrate, and anodizing the substrate a second time.

Mentioned hereinafter is in one example of implementing the steps previously mentioned. It is to be appreciated that the materials mentioned hereinafter are for illustrative purposes only and not meant to be limiting.

The first step of printing the mask can include printing on to the substrate using an inkjet printer and ultraviolet (UV) curing inks. For instance, one brand of print head is a K600i piezo drop-on-demand (DOD) print head manufactured by Domino Printing Sciences, PLC. The substrate may be any suitable metallic or metal oxide substrate. In one instance, the substrate can be a roll material including a layer of niobium metal-coated aluminum foil laminated to a polymeric film. It is to be appreciated that other types and configurations of a substrate can be implemented. Generally, the step of printing on the substrate is comparable to printing techniques which can be used to print on sheet and/or roll of any suitable substrate.

The second step of anodizing the substrate can include conventional and well known techniques to build a desired depth of niobium oxide on the niobium surface layer. Generally, the first anodization can include anodizing the substrate in a weakened anodizing solution. It is to be appreciated that the substrate can be treated in any desired manner that is useful to the user of the process. It is to be appreciated that the specific manner of treating the substrate can differ from the niobium anodization steps described herein. For instance, anodization may be performed using other metals and metal oxides. In yet other instances, other types of coatings can be used in place of anodization.

The third step of removing the ink mask can be started by treating the printed mask areas of the substrate. For instance, a solution or solvent can be generally applied to the printed mask areas. If the mask is an inkjet printed UV cured ink, the substrate can then typically be heated to an elevated temperature. In one embodiment, a cleaning solution and/or suitable solvent can be applied to the printed mask areas while the substrate is being heated. In some instances, machines and/or devices enabling an application of the solution and/or solvent are contemplated. The cleaning solution and/or solvent can include, but are not limited to, methylene chloride, acetone, toluene, N-methyl 2-pyrrolidone, monoethanolamine, and various mixtures. Generally, the substrate can be either contemporaneously or immediately thereafter heated to an elevated temperature after applying the cleaning solution and/or solvent. It is to be appreciated that the substrate can be heated based on the type of ink and printer used to apply the ink.

In one embodiment, the elevated temperature can be approximately 160° F. to 240° F. In another embodiment, the elevated temperature can be approximately 180° F. to 220° F. In yet another embodiment, the elevated temperature can be approximately 190° F. to 210° F. As can be appreciated, the substrate used in the present process should be able to withstand an elevated temperature without unacceptable degradation.

In another example of the third step, the cleaning solution can be applied by running the imprinted or masked side of the roll material over a roller coated with the cleaning solution and then heated from a backside by running the material over a heated roll. As can be appreciated, the combination of the cleaning solution and the heat can weaken a bond between the substrate and the inkjet printed UV cured ink. The inkjet printed UV cured ink can then be washed off with a room temperature water spray rinse after being treated.

Of significant note, the previously described examples of removing the mask do not work with UV cured inks applied by other printing processes, such as flexographic printing. The aforementioned examples are for inkjet printed UV cured inks.

The fourth step can include anodizing the substrate for a second time. It is to be appreciated that the second anodization can include conventional and well known techniques to build a desired depth of niobium oxide on the niobium and niobium oxide surfaces. It is to be further appreciated that other types of coatings, metals, and metal oxides can be used in place of anodization.

Embodiments of the present invention also include tags and labels made by the foregoing processes that incorporate continuously variable printed indicia therein. The labels can be used for any number of applications as would be obvious to one of ordinary skill in the art to which the invention pertains given the benefit of this disclosure.

TERMINOLOGY

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

Directional and/or relationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

An Embodiment of a Tamper-Evident Label Forming Process

Referring to FIG. 1, a flow chart of a method or process 100 is illustrated. The process 100 can be implemented to form tamper-evident labels by implementing printed masks on metallic substrates. In one embodiment, the tamper-evident label forming process 100 can be implemented to form anti-counterfeiting and/or authenticating labels.

In block 102, a metallic or metal oxide substrate can be printed onto to form an ink mask. For instance, a metallic substrate can be printed on by an inkjet printer with ultraviolet cured ink. Generally, when implementing an inkjet printer and UV cured ink, continuously variable alphanumeric characters or similar can be printed onto the substrate with high image definition and quality.

Once the UV cured ink has been cured, the substrate can be anodized in a weakened anodizing bath in block 104. In one example, fluoride can be added to an anodizing bath solution to weaken a bond between the anodized layer and the surface of the substrate. As will be appreciated hereinafter, the weakened bond can be implemented to allow the oxide layer to break away from the substrate when the substrate is stressed. It is to be appreciated that an area under the printed ink mask will not have been anodized.

In block 106, the ink mask can be removed from the substrate. Depending on the type of ink and printer type used to make the mask, one or more processes are contemplated to be used to remove the ink from the substrate. For example, if water-based flexographic inks were used, a high pH water mixture can be used to remove the flexographic ink. A process for removing inkjet printed UV cured ink is described hereinafter in more detail.

In block 108, the substrate can be anodized a second time. Typically, when the substrate is anodized a second time, the anodizing bath will not include fluoride to be weakened. Since the printed mask areas were not anodized a first time, a strong bond can be formed between the surface of the substrate where the mask was printed on and the second anodized layer. In one instance, the second anodizing step can create a uniform layer on the substrate.

Figure 2:
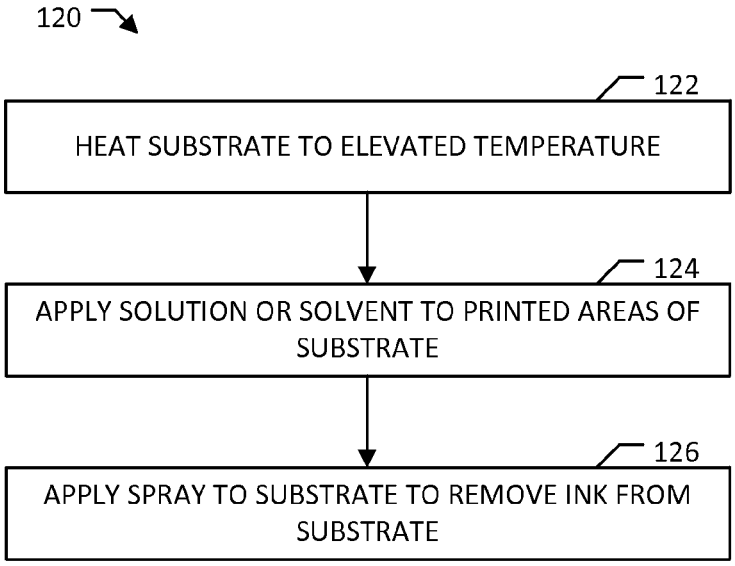
FIG. 2 is a flow chart of a process for removing ink from a substrate according to one embodiment of the present invention.

Referring to FIG. 2, a flow chart of one example of a process 120 for removing inkjet printed ultraviolet cured ink from a substrate is illustrated. Typically, a process for removing the ink can be determined based on the type of ink printed on the substrate. In this example, the process 120 can be implemented to remove an inkjet printed ultraviolet cured ink from a niobium metal-coated aluminum foil substrate. It is to be appreciated that the ink removal process 120 typically may not work for other types of ink and printer combinations.

In block 122, the substrate can be heated to a temperature between 160° F. to 240° F. In one embodiment, the substrate can be heated between 180° F. to 220° F. In another embodiment, the substrate can be heated between 190° F. to 210° F.

After the substrate has been heated, the printed portions of the substrate can be subjected to a cleaning solution and/or a solvent in block 124. It is to be appreciated that the cleaning solution and/or solvent can be applied before, during, or after the substrate has been heated. In one example, a felt tip marker can be dipped into the cleaning solution and then used to apply the cleaning solution to the printed mask areas. The cleaning solution and/or solvent can include, but are not limited to, methylene chloride, acetone, toluene, N-methyl 2-pyrrolidone, monoethanolamine, and various mixtures thereof. Typically, the cleaning solution and/or solvent, along with the heat, can be implemented to weaken the bond between the UV cured ink and the substrate.

In block 126, the substrate can be cooled to room temperature and a water spray rinse can be applied to the substrate to wash off the UV cured ink. After the UV cured ink has been removed, the substrate can be anodized a second time.

Embodiments of a Tamper-Evident Label

Referring to FIGS. 3A-3D, detailed diagrams of a tamper-evident label at various steps of the tamper-evident label forming process 100 are illustrated.

Figure 3A:
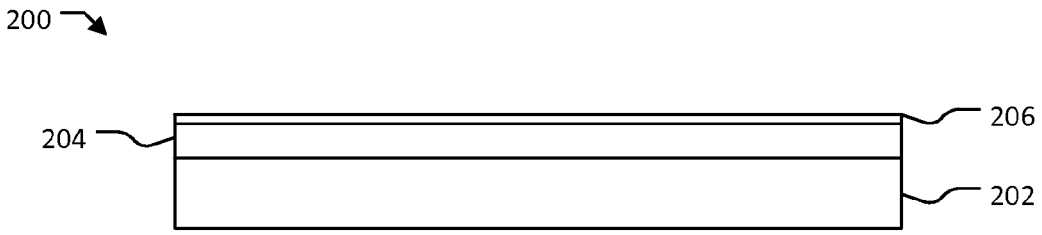
FIGS. 3A-3D include various side views of a tamper-evident label at differing steps of a process for creating a tamper-evident label according to one embodiment of the present invention.

Referring to FIG. 3A, a substrate 200 including, but not limited to, a polymer layer 202, a first metal layer 204, and a second metal layer 206 is shown. In one example, the polymer layer 202 can be a polyethylene terephthalate (PET) having a thickness of approximately 25 to 50 micrometers. The first metal layer 204 can be aluminum having a thickness of approximately 8 to 10 micrometers. The second metal layer 206 can be either niobium or tantalum having a thickness of approximately 1000 to 1200 angstroms. Generally, the second metal layer 206 can be deposited on the aluminum layer 204 by sputtering. For instance, a continuous web vacuum sputtering process can be implemented to sputter the second metal layer 206 onto the first metal layer 204.

Figure 3B:
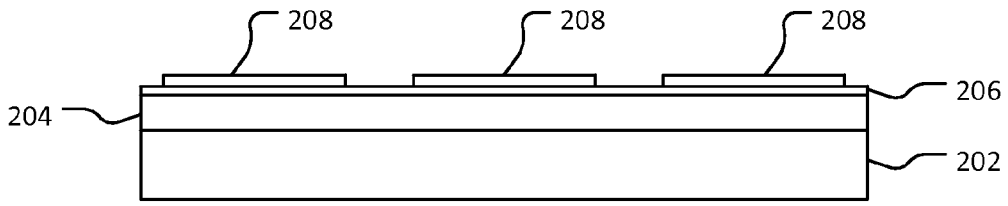

Referring to FIG. 3B, the substrate 200 is shown with a plurality of ink masks 208 printed onto the substrate. As shown, the plurality of ink masks 208 can be printed on top of the second metal layer 206.

Figure 3C:
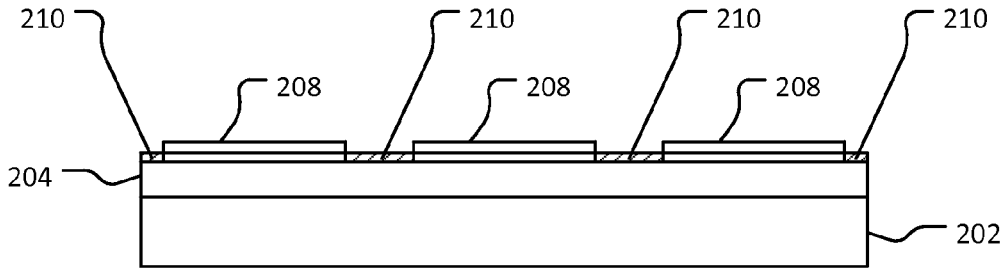

Referring to FIG. 3C, the substrate 200 is shown after the substrate has been anodized a first time in a weakened anodizing bath. An oxide layer 210 is shown where the printed masks 208 were not present. Of note, the areas under the printed masks 208 were not anodized. The entire second metal layer 206 is shown to have been oxidized to form the oxide layer 210 for illustrative purposes only. It is to be appreciated that a portion of the second metal layer 206 would likely remain between the oxide layer 210 and the first metal layer 204. It is to be appreciated that the oxide formation of the oxide layer 210, during anodization, occurs at a top and within a top portion of the second metal layer 206. As such, a thickness of the second metal layer 206 may not increase much during the anodization.

Figure 3D:
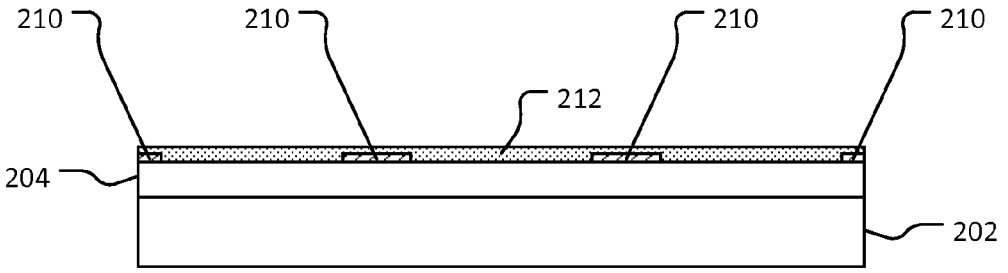

Referring to FIG. 3D, the substrate 200 is shown after the ink masks have been removed, and the substrate 200 was anodized a second time. Of note, a second anodized layer 212 is shown. The second anodized layer 212 can create a strong bond with the first metal layer 204 and the second metal layer 206, whereas a weak bond was formed between the first anodized layer 210 and the second metal layer 206. As such, when the substrate 200 is stressed, the first anodized layer 210 will break away from the first metal layer 204 while the second anodized layer 212 will stay attached to the first metal layer 204. It is to be appreciated that the second metal layer 206 may not be entirely oxidized after the second anodization.

It is to be appreciated that FIGS. 3A-3D are for illustrative purposes and not meant to be limiting. For instance, the second metal layer 206 may not be completely converted to an oxide layer, as shown in FIGS. 3C and 3D.

An Example of the Tamper-Evident Label Forming Process

Referring to FIGS. 4A-4G, several color illustrations of a tamper-evident label at various stages created using the label forming process 100 are shown. The example implementation of the label forming process 100 can utilize a laminated roll material having a niobium-coated aluminum foil surface and a plastic film backing. The material can typically be supplied in roll. The mask can be printed on the metallic surface of the roll material. In the example implementation, the mask can be applied by two different printing techniques. A border, which appears yellow in color, can be applied using flexographic printing with a water-based ink. A set of continuously variable alphanumeric characters, located inside the borders, can be printed using an inkjet printer employing a UV cured ink.

Figure 4A:
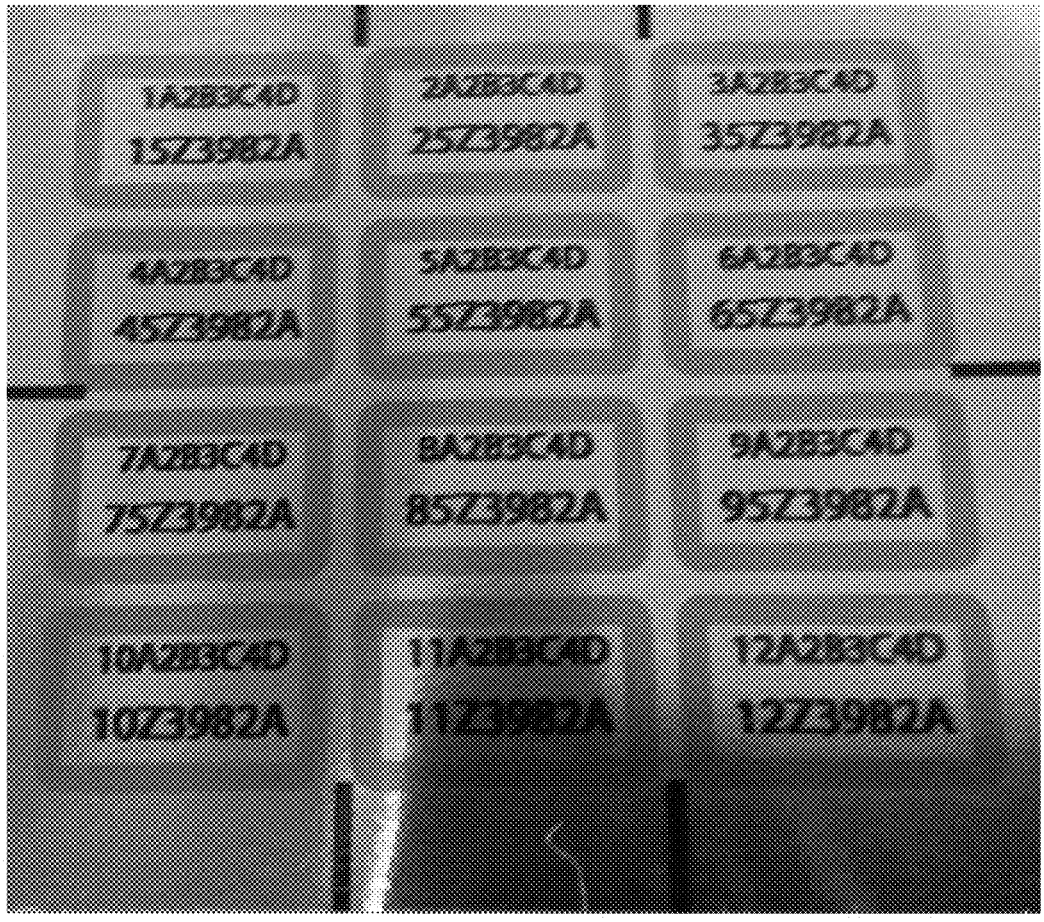
FIGS. 4A-4G include images of a tamper-evident label at various stages of a process for creating a tamper-evident label according to one embodiment of the present invention.

Referring to FIG. 4A, an aluminum substrate with a thin (1200 angstroms) top-layer of niobium metal having a plurality of labels or tags printed thereon is illustrated. As previously mentioned, the substrate can include a plurality of yellow borders flexographically printed using water-based flexographic inks and a plurality of unique numbers centered inside the borders printed with an ink jet printer using UV cured ink. It is to be appreciated that either the borders or the numbers can be printed first. In one embodiment, each of the bordered areas can be an individual label or tag. It is to be appreciated that post processing can include cutting the substrate up into the individual labels or tags.

Figure 4B:
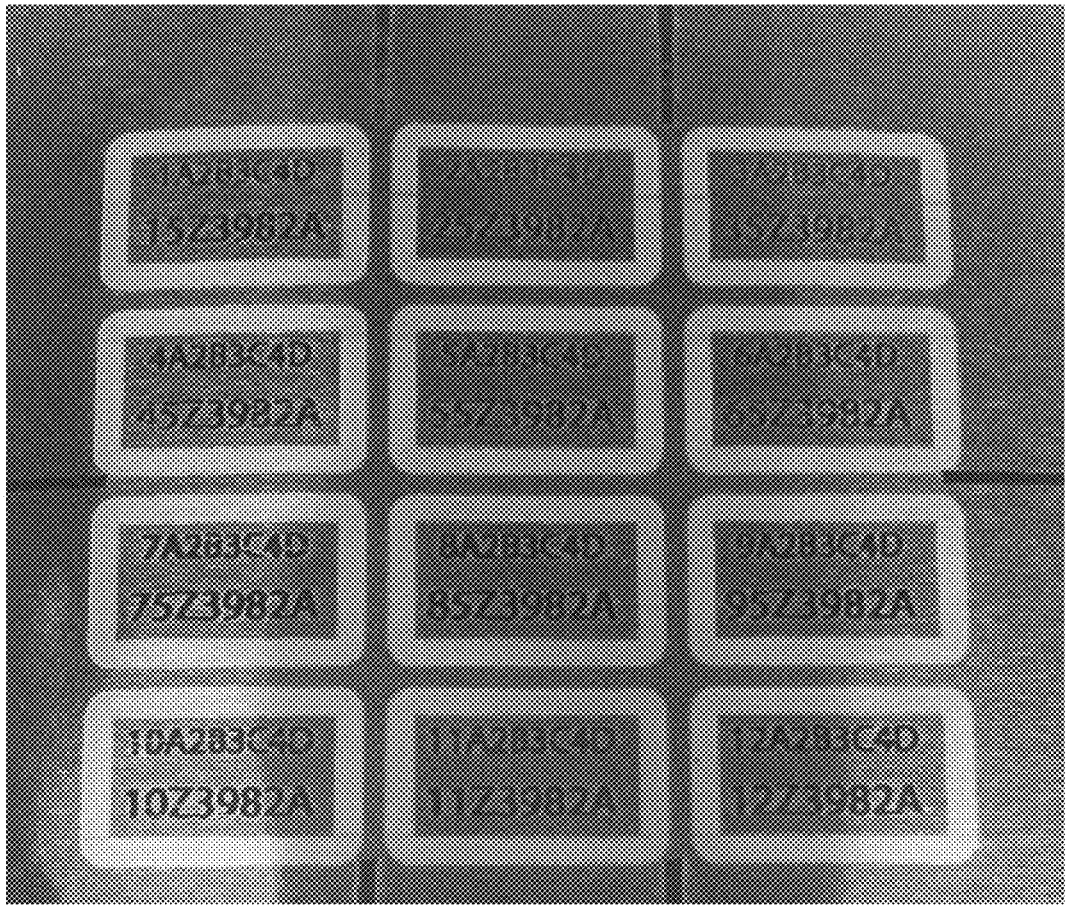

Referring to FIG. 4B, the substrate is shown after having been electrically anodized. Once the mask(s) have been applied, the substrate can be passed through one or more anodizing baths to anodize the surface of the substrate. Anodization can be implemented to form a niobium oxide layer of a desired thickness on the substrate. It is to be appreciated that the oxide layer can form via oxygen transport and oxidation/reduction during electrolysis.

The thickness of the anodized surface typically determines how light is refracted and reflected therefrom giving the surface a particular appearance and color. It is to be appreciated that the oxide formation changes a refractive index allowing for the color variation. As shown, the anodized surface of metallic niobium oxide appears blue as a result of a reflection and a refraction of light through the anodized layer having a particular thickness. The printed regions remain having effectively masked the surface there under from being anodized.

In one instance, to weaken an adherence of the anodized layer to the substrate, fluoride can be added to one of the anodizing baths. For example, fluoride in an approximate concentration of 200 parts per million can be added to the anodizing bath. It is to be appreciated that the incorporation of fluoride, for instance added as a soluble sodium salt (e.g., sodium fluoride), during the first anodization leads to incorporation of the fluoride in the first anodized layer. For instance, the fluoride can form an ionic complex with the niobium that can be incorporated into the same region as the first anodized layer. The fluoride can be implemented to weaken an interface between the first anodized layer and the niobium top layer.

Figure 4C:
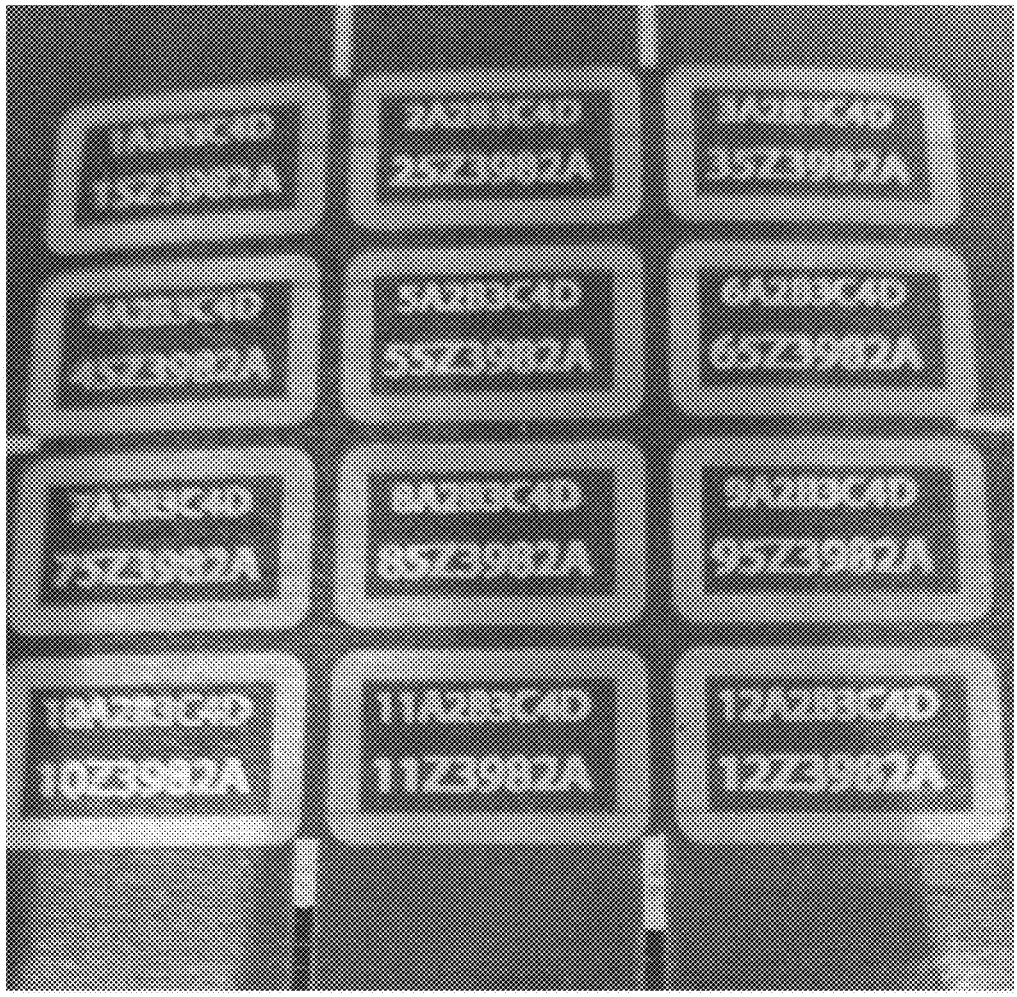

Referring to FIG. 4C, the substrate is shown after the UV cured ink and the flexographic ink have been substantially removed therefrom. Of note, where the substrate was previously printed on is exposed having not been anodized. In one example, an ink stripping solution implemented to remove the printed ink can include, but is not limited to, an aqueous solution paint/varnish stripper. For example, MAGIC STRIP® Citrus-Action manufactured by RUSTOLEUM® can be implemented to remove the UV cured ink. It is to be appreciated that the substrate was heated in addition to the application of the ink stripping solution.

Figure 4D:
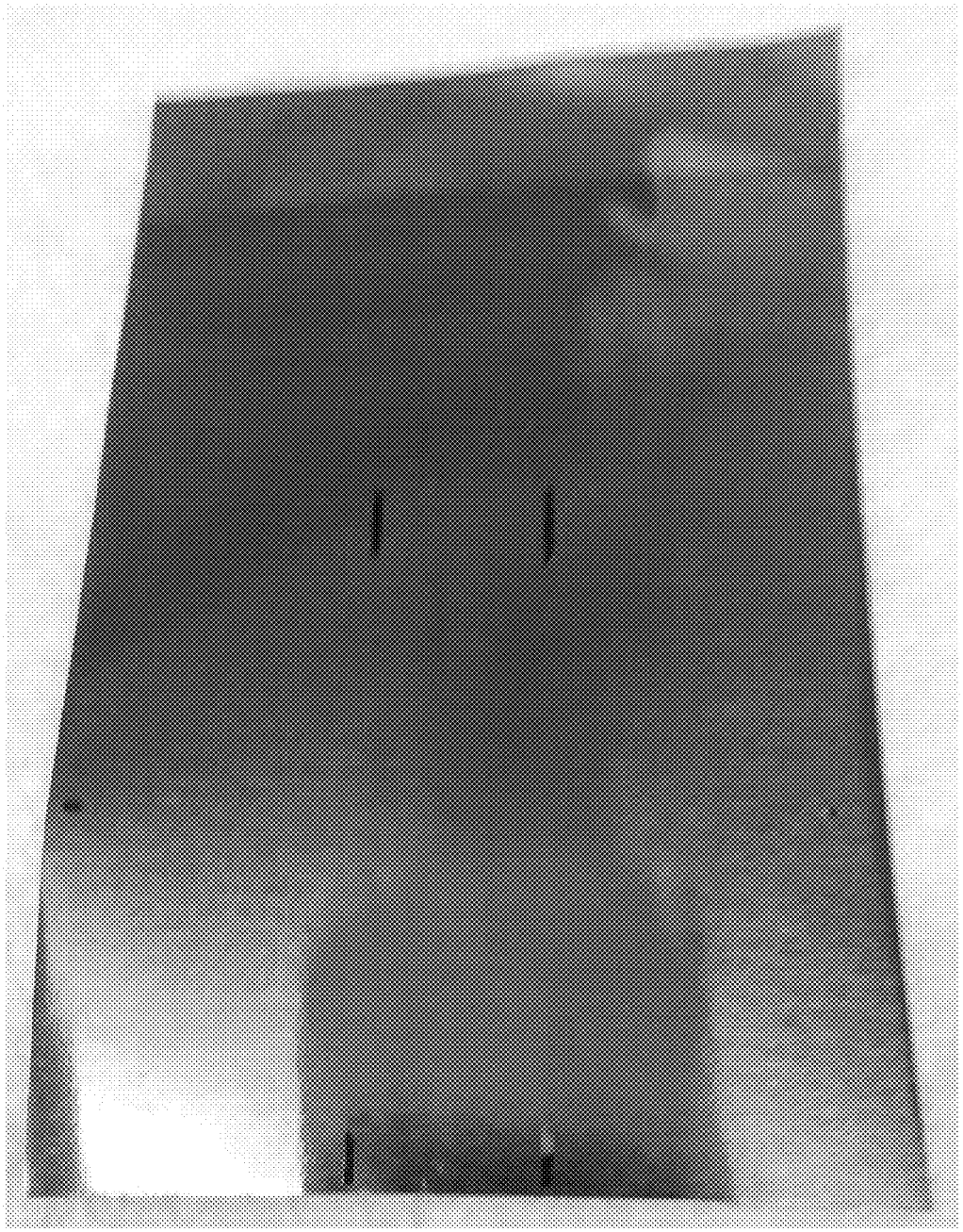

Referring to FIG. 4D, the substrate is shown after the substrate has been anodized for a second time. The second anodization bath does not typically include added fluoride. By leaving out the fluoride in the second anodization step, the bond between the niobium oxide layer and an area previously covered by the printed mask can be strong. The thickness of the niobium oxide layer can be built up over the previously formed oxide in addition to building the metallic oxide over the previously masked surfaces. Typically, a surface of the substrate can have a uniform surface appearance with no evidence of the underlying areas where the mask was applied. Due to the increased thickness of the niobium oxide, the refracted and reflected color of the substrate surface appears a pinkish purple. The sheet can then be cut into individual labels for any suitable and desired purpose. Of note, on the surface of the substrate shown in FIG. 4D, two small black lines can still be seen. These lines were part of the inkjet mask but were not subjected to the cleaning solution. As such, the lines were not removed during the spray rinse.

In the present example, the formerly printed portions are also anodized. A total thickness and refraction properties of the metallic oxide formed by the combination of the first and second anodizing steps can be different from the total thickness and refraction properties of the metallic oxide formed by the first anodizing step. As shown, the substrate surface can have a pink/purple appearance. Except for cutting the labels into discreet pieces and applying an adhesive layer to the backside, the labels are complete and ready for use.

Figure 4E:
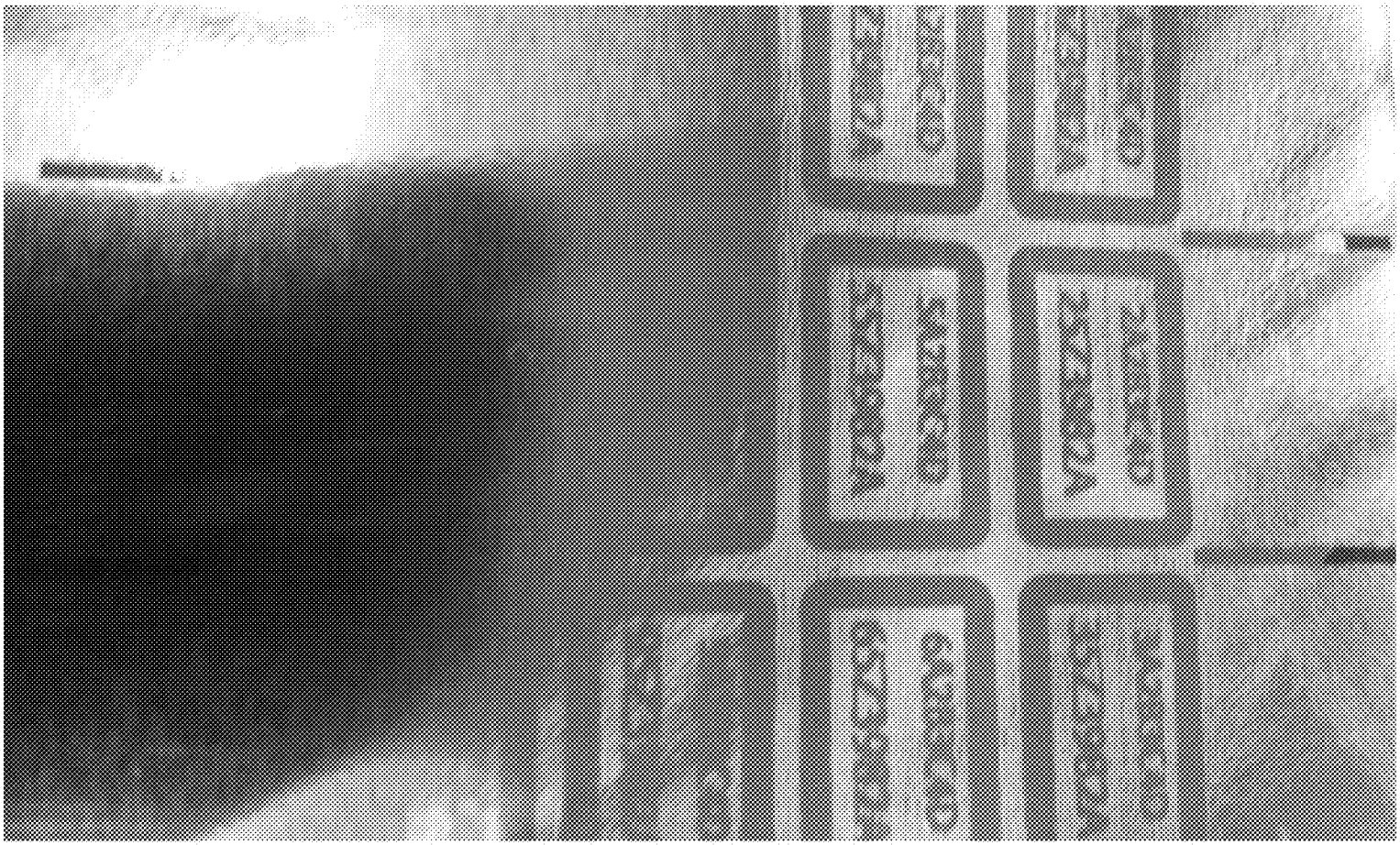

Referring to FIG. 4E, the substrate is shown where part of the substrate has been stressed destroying the anodized coating in the regions surrounding the formally printed areas. When stressed, the substrate reveals the border and unique numbers since the areas having a weakened bond are separated from the top layer of the substrate.

When the substrate is stressed, the niobium oxide layer loses adhesion with the aluminum layer of the substrate at the weakened niobium oxide/niobium interface formed during the first anodization with added fluoride. Typically, when stressed, the rigid niobium oxide layer is fractured and the oxide layer degrades. As shown, in the stressed regions the disrupted oxide no longer refracts the light in the same manner as before and the clear surface of the niobium coated aluminum can be seen. Near the bottom of FIG. 4E, the substrate has not been stressed and the full colored oxide remains intact. The destruction of the anodized layer reveals the previously printed mask since the anodized layer adhered to the previously masked portions comprises only niobium oxide from the second anodization that was not compromised in its ability to form a strong bond with the substrate through the addition of fluoride to the anodizing bath.

As can be appreciated, the addition of fluoride to the anodization bath is only one means for weakening the resulting niobium oxide layer's adherence to the substrate and that other additives can serve a similar purpose. Further, by adjusting the concentration of additives to the bath, the resulting adhesive strength of the oxide layer to the substrate can also be adjusted.

Figure 4F:
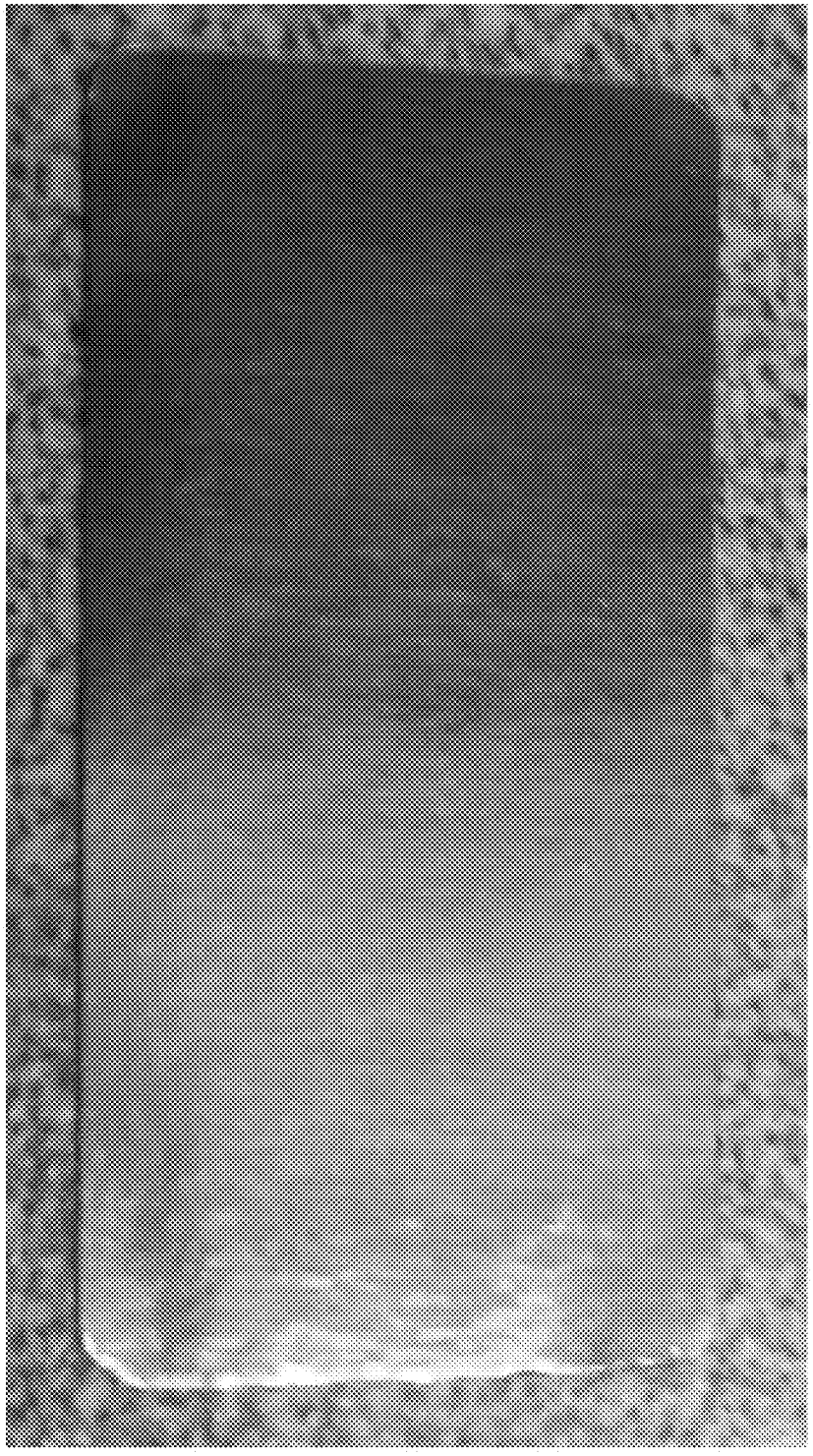
Figure 4G:
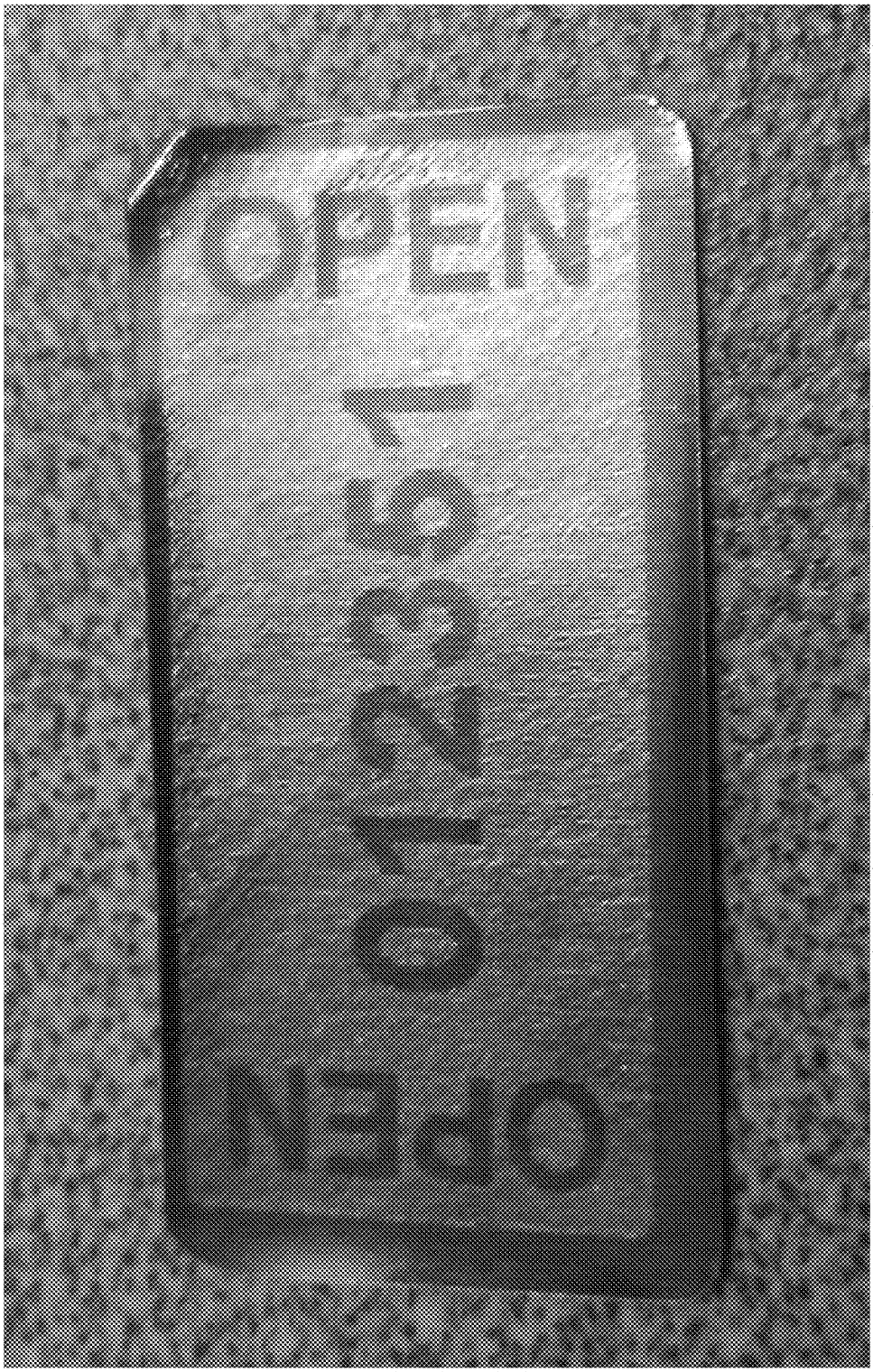

FIGS. 4F-4G illustrate a tamper-evident label prior to being stressed and after the label has been stressed. As shown in FIG. 4G, when the label is stressed, the oxide layer is broken up except where the previously masked regions were printed on, thereby revealing hidden indicia. Referring to FIG. 4F, a completed tamper-evident label that appears blue is shown. Referring to FIG. 4G, the tamper-evident label after the label has been stressed, thereby destroying the underlying first anodized layer and revealing the unique identifier, is shown.

Example Components of the Anodization Steps

Described hereinafter is one example of anodizing components that can be implemented in the label forming process 100.

Components implemented in steps of anodizing the substrate in the label forming process 100 can include, but are not limited to, an anodization bath having a stainless steel cathode, a DC power supply, a voltage timer for the power supply, a substrate, a spring clamp adapted to hold substrates in the anodization bath, and de-ionized (DI) water.

In a first anodization bath, a first electrolyte can be implemented in the step of passing the substrate through an anodizing bath a first time. The first electrolyte can include, but is not limited to, 0.05M potassium citrate having a pH of approximately 6.5 to 6.8, and approximately 25 parts per million (ppm) to 45 ppm fluoride for tantalum coated substrates or approximately 100 ppm to 500 ppm fluoride for niobium coated substrates. Typically, a precise fluoride concentration can be determined based on a desired anodized color of the substrate.

In a second anodization bath, a second electrolyte can be implemented in the step of passing the substrate through an anodization bath for a second time. The second electrolyte can include, but is not limited to, 0.05M potassium citrate having a pH of approximately 6.5 to 6.8.

The first anodization of the substrate can include the following steps. First, an anodizing bath can be filled with the previously mentioned first electrolyte. Typically, the bath can be filled to within ¾ an inch of a top of the bath. Second, the substrate can be attached to a side of the anodizing bath opposite a side the cathode is on. The metal coated surface of the substrate should be facing the cathode. Third, a positive lead from the power supply can be connected to a clip attaching the substrate to the anodizing bath and a negative lead from the power supply can be connected to the cathode. Fourth, a current control of the power supply can be set to a maximum with the voltage set to 25 volts. Fifth, the voltage timer can be set for 15 seconds. It is to be appreciated that the voltage setting can be set approximately from 23 volts to 35 volts depending on a final product color and activation sensitivity. Sixth, after the substrate has been anodized, the substrate can be removed from the anodizing bath and rinsed. The substrate can be rinsed with an aqueous solution having a pH of approximately 9 to 11. The substrate can then be rinsed with clean water and dried.

After the removal of the ultraviolet cured ink, the following steps can be followed to anodize the substrate for a second time.

The second anodization of the substrate can include the following steps. First, an anodizing bath can be filled with the previously mentioned second electrolyte. Typically, the bath can be filled to within ¾ an inch of a top of the bath. Second, the substrate can be attached to a side of the anodizing bath opposite a side the cathode is on. The metal coated surface of the substrate should be facing the cathode. Third, a positive lead from the power supply can be connected to a clip attaching the substrate to the anodizing bath and a negative lead from the power supply can be connected to the cathode. Fourth, a current control of the power supply can be set to a maximum with the voltage set to 70 volts. Fifth, the voltage timer can be set for 30 seconds. Sixth, after the substrate has been anodized, the substrate can be removed from the anodizing bath and rinsed. The substrate can be rinsed with clean water and dried.

Example voltage settings for niobium coated substrates and tantalum coated substrates, which can be used to produce different colored substrates, are hereinafter listed.

For tantalum, 85 volts can produce a gold color, 102 volts can produce a wine color, 112 volts can produce a purple color, 121 volts can produce a blue color, and 134 volts can produce a Green color.

For niobium, 55 volts can produce a gold color, 70 volts can produce a wine color, 75 volts can produce a purple color, 80 volts can produce a blue color, and 90 volts can produce a green color.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

As can be appreciated, the applicant considers embodiments of the invention to require at a minimum only a subset of the steps or operations disclosed herein. Other embodiments may include all steps whereas others can include an intermediate number of steps and/or additional steps not disclosed herein that would otherwise be obvious in light of this disclosure to someone of ordinary skill in the art to which the present invention pertains. Further as will obvious from this disclosure, other embodiments comprise labels or other metallic items fabricated at least in part using the described process.

I claim:

1. A method for creating a tamper-evident label, the method comprising:

by an inkjet printer, printing ultraviolet cured ink onto a surface of a substrate;

anodizing the surface of the substrate a first time;

removing the ultraviolet cured ink from the surface of the substrate, wherein removing the ultraviolet cured ink from the substrate includes:

heating the substrate to a temperature between 160° F. to 240° F.;

applying a solution to the printed areas on the substrate; and applying a water spray to the substrate;

anodizing the surface of the substrate a second time forming a uniform oxide layer on the substrate.

2. The method of claim 1, wherein the step of anodizing the surface of the substrate the first time includes creating a weakened bond between a first anodized layer and the surface of the substrate.

3. The method of claim 2, wherein the weakened bond is created by passing the substrate through an anodizing bath having fluoride at a concentration approximately between 100 to 500 parts per million.

4. The method of claim 3, wherein when a stress is applied to the substrate the weakened bond between the first anodized layer and the surface of the substrate is broken.

5. The method of claim 1, further comprising the step of:

printing flexographic ink onto the surface of the substrate before anodizing the surface of the substrate.

6. The method of claim 5, wherein the step of printing flexographic ink includes printing one or more borders on the surface of the substrate.

7. The method of claim 6, wherein the step of printing ultraviolet cured ink includes printing continuously variable alphanumeric characters on the surface of the substrate.

8. The method of claim 7, wherein the continuously variable alphanumeric characters are printed within one of the one or more borders.

9. The method of claim 1, wherein the solution is selected from the group consisting of methylene chloride, acetone, toluene, N-methyl 2-pyrrolidone, monoethanolamine, and combinations of two or more of the listed solutions.

10. The method of claim 1, wherein the substrate is a niobium metal-coated aluminum foil.

11. The method of claim 10, wherein a layer of niobium oxide including a niobium fluoride complex is formed on the surface of the substrate during the first anodizing step.

12. The method of claim 1, wherein the substrate is a roll material including a layer of niobium metal-coated aluminum foil laminated to a polymeric film.

13. The method of claim 1, wherein the step of printing ultraviolet cured ink includes printing continuously variable characters on the surface of the substrate.

14. The method of claim 1, wherein the step of printing ultraviolet cured ink includes printing continuously variable alphanumeric characters on the surface of the substrate.

15. A method for creating a tamper-evident label, the method comprising:

by an inkjet printer, printing ultraviolet cured ink onto a surface of a niobium metal-coated aluminum foil substrate;

anodizing the surface of the substrate in a first anodizing bath including fluoride at a concentration of approximately 100 to 500 parts per million, wherein the anodizing bath forms a niobium oxide layer on the surface of the substrate;

removing the ultraviolet cured ink from the surface of the substrate, wherein removing the ultraviolet cured ink from the substrate includes:

heating the substrate to a temperature between 160° F. to 240° F.;

applying a solution to the printed areas on the substrate; and applying a water spray to the substrate;

anodizing the surface of the substrate in a second anodizing bath, wherein the second anodizing bath forms a uniform niobium oxide layer on the surface of the substrate.

16. The method of claim 15, wherein the niobium oxide layer includes a niobium fluoride complex.

17. The method of claim 15, wherein the step of printing ultraviolet cured ink includes printing continuously variable characters on the surface of the substrate.

18. The method of claim 15, wherein the step of anodizing the surface of the substrate in the second anodizing bath includes anodizing at a voltage between 55 to 90 volts.

19. The method of claim 18, wherein the voltage determines a color of the tamper-evident label.

20. A method for creating a tamper-evident label, the method comprising:

by an inkjet printer, printing ultraviolet cured ink onto a surface of a tantalum metal-coated aluminum foil substrate;

anodizing the surface of the substrate in a first anodizing bath including fluoride at a concentration of approximately 25 to 45 parts per million, wherein the anodizing bath forms a tantalum oxide layer on the surface of the substrate;

removing the ultraviolet cured ink from the surface of the substrate, wherein removing the ultraviolet cured ink from the substrate includes:

heating the substrate to a temperature between 160° F. to 240° F.;

applying a solution to the printed areas on the substrate; and applying a water spray to the substrate;

anodizing the surface of the substrate in a second anodizing bath, wherein the anodizing bath forms a uniform tantalum oxide layer on the surface of the substrate.

* * * * *